United States Patent [19]

Hansel

[11] 4,049,029

[45] Sept. 20, 1977

[54] VALVE SYSTEM FOR A VAPOR RECEIVING SYSTEM ON A DISPENSING NOZZLE

[75] Inventor: William B. Hansel, Media, Pa.

[73] Assignee: Suntech, Inc., St. Davids, Pa.

[21] Appl. No.: 665,147

[22] Filed: Mar. 8, 1976

[51] Int. Cl.[2] ..... B65C 3/02

[52] U.S. Cl. ..... 141/206; 141/303

[58] Field of Search ..... 141/303, 59, 206–229, 141/46

[56] References Cited

U.S. PATENT DOCUMENTS

| | | | |
|---|---|---|---|
| 2,330,616 | 9/1943 | Parker | 141/303 |
| 2,771,917 | 11/1956 | Cannell | 141/303 |
| 3,732,902 | 5/1973 | Muller | 141/303 |

FOREIGN PATENT DOCUMENTS

| | | | |
|---|---|---|---|
| 1,068,161 | 2/1954 | France | 141/303 |

*Primary Examiner*—Houston S. Bell, Jr

*Attorney, Agent, or Firm*—J. Edward Hess; Donald R. Johnson

[57] ABSTRACT

A valve system for the vapor receiving system of a gasoline dispensing nozzle which acts to prevent the flow of liquid gasoline into the vapor return line in the event that the automatic shut-off system of the nozzle fails to turn the nozzle off. The valve system has a valve seat located at the point where the vapor return line connects to the vapor receiving system and a floating member suspended below the valve seat in such a manner that when the vapor receiving chamber fills with gasoline, the floating member covers the valve seat so that no gasoline flows back through the vapor return line. A shield can also be provided to prevent closure of the floating member by the normal flow of vapors.

6 Claims, 5 Drawing Figures

VALVE SYSTEM FOR A VAPOR RECEIVING SYSTEM ON A DISPENSING NOZZLE

BACKGROUND OF THE INVENTION

This invention is related to vapor receiving systems for use on gasoline dispensing nozzles and more particularly to a check valve system for use with the vapor receiving system to prevent gasoline from being pumped back through the vapor receiving system and the vapor return line in the event that the nozzle should fail to shut off.

Current environmental regulations will require in some areas that gasoline vapors displaced from a vehicle fuel tank when being filled are to be recovered in order to prevent their escape into the atmosphere. One method of accomplishing this result is to have a closed filling system when the vapors displaced from the fuel tank are forced back into the underground hydrocarbon storage tanks. Vapor receiving systems which will accomplish this result usually include a receiving system designed to have a flexible vapor receiving chamber surrounding the discharge spout of the nozzle, a sealing section for making a tight seal against the vehicle fill-pipe, and a vapor return line connecting the vapor receiving chamber to the underground hydrocarbon storage tank.

When using a nozzle having such a vapor receiving system, a few complications can develop. One problem is that in the event the automatic shut-off system of the nozzle does not operate properly, once the gasoline tank is filled, gasoline can be forced back through the vapor receiving system and into the underground tanks through the vapor return line. The gasoline pump meter will then indicate that more gallons of gasoline have been pumped into the gas tank than the gas tank is capable of holding.

SUMMARY OF THE INVENTION

In accordance with a preferred embodiment, a check valve system is provided which can be located at the entrance of the vapor return line to the vapor receiving chamber to prevent the flow of liquid hydrocarbons into the vapor return line. The valve is designed to be mounted in conjunction with the vapor return line entrance located in the upper portion of the vapor receiving chamber. A valve seat is formed at the entrance of the vapor return line in the vapor receiving chamber. A floating valve member is supported below the valve seat in such a manner that it does not interfer with the normal flow of vapors into the vapor return line and will be permitted to float upward against the valve seat in the event that liquid gasoline fills the vapor receiving chamber. A slide hinge mounting system for the floating valve head permits it to rest far enough below the valve seat so that the flow of vapors through the valve seat does not cause the floating member to be forced against the valve seat, thereby hindering the collection of vapors. a shield for the floating member is also provided to prevent the flow of vapors against the floating member, which could close the valve arrangement during the normal vapor flow.

A better understanding of the invention and its advantages can be seen in the following description of the figures and preferred embodiments.

DESCRIPTION OF THE FIGURES AND PREFERRED EMBODIMENTS

For purposes of describing the check valve in its operation the nozle and vapor receiving system disclosed in a copending application entitled "GASOLINE DISPENSING NOZZLE WITH VAPOR RECEIVING SYSTEM", Ser. No. 609,760, filed Sept. 2, 1975, and in U.S. Pat. No. 3,734,339, issued to E. T. Young, will be used for illustrative purposes.

Figure 1:
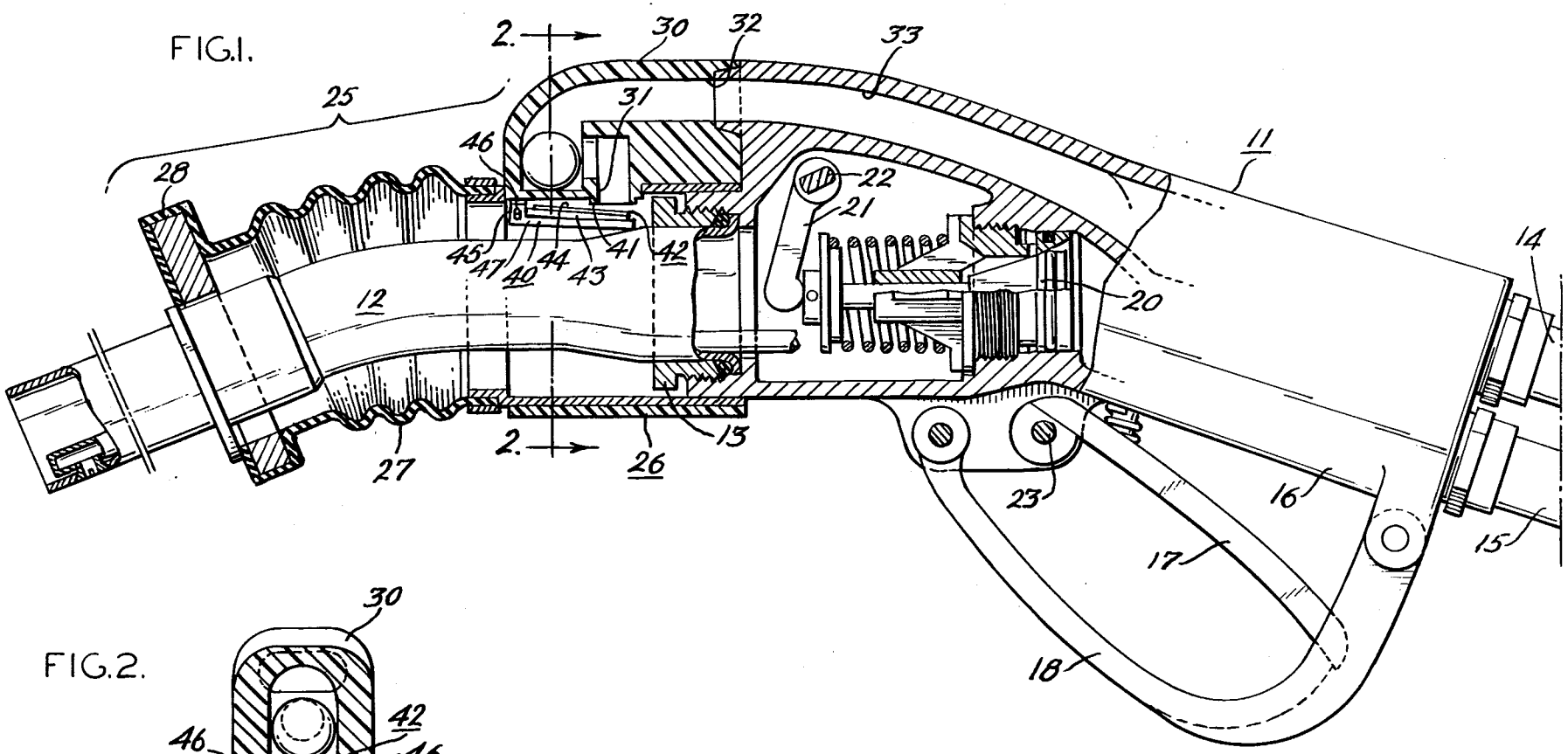
FIG. 1 is a partial section of a typical gasoline dispensing nozzle with a vapor receiving system showing the placement of the check valve system according to this invention.

Referring to FIG. 1, a brief description of a basic nozzle and vapor receiving system will be made. The nozzle assembly has a housing 11 with a discharge spout 12 connected thereto by retaining nut 13. Vapor return hose 14 and gasoline hose 15 connect to handle portion 16 of housing 11. Operation of the nozzle is accomplished by squeezing lever 17 against handle 16. Guard 18 acts to protect actuating lever 17 as well as to provide a support for holding the nozzle when it is inserted into the pump housing.

The components inside nozzle housing 11 include a main valve 20 which is opened when arm 21 of shaft 22 is rotated toward the valve. Shaft 22 is connected to pivot shaft 23 of lever 17 through an automatic shut-off mechanism (not shown) which prevents gasoline from being dispensed when the liquid level in the container reaches the end of spout 12. The shut-off mechanism can be a pressure responsive diaphragm system, principles of which are well-known. A more detailed explanation of the operation of this nozzle is contained in a patent obtained by E. T. Young, U.S. Pat. No. 3,734,339.

The vapor receiving system includes a vapor receiving chamber, generally denoted by the numeral 25, which comprises three general sections, non-flexible housing 26, flexible bellows 27, and magnetic sealing section 28. Mounted on the top of non-flexible housing 26 is an attitude valve, generally denoted by the numeral 30, which has an inlet port 31 on the inside of vapor receiving chamber 25 and an outlet port 32 connected to vapor return passageway 33, which passes through the inside of nozzle housing 11 to the connection with vapor return hose 14. The fluid flow path formed by attitude valve 30, vapor return passageway 33 and vapor return hose 14 will be generally referred to as the vapor return line. A more detailed description of the vapor receiving system itself is contained in the above mentioned application, Ser. No. 609,670.

Attitude valve 30 is designed so that when the nozzle is placed in its dispensing position, vapors are permitted to flow through the valve itself and back into the underground storage tanks through vapor return passageway 33 and vapor return hose 14. When the nozzle is placed in an upward position, such as when placed on the pump housing when not in use, the valve then obtains a closed position such that no vapors can flow from the underground tanks into the atmosphere through the vapor return line. The particular features of an attitude valve similar in design and operation to attitude valve 30 are discussed in the copending application entitled "Attitude Valve For Gasoline Dispensing Nozzle", Ser. No. 609,671, filed Sept. 2, 1975.

The check valve system is designed to be mounted inside non-flexible housing 26 of vapor receiving chamber 25 at the point where the vapor return line entrance is located. The location of the entrance of the vapor return line will be defined as being in the upper portion of non-flexible housing 26 since in operation, the nozzle will normally assume an essentially horizontal position when filling most fuel tanks. In the particular illustration used, the entrance of vapor return line is the inlet 31 of attitude valve 30.

The check valve system, generally denoted by the numeral 40, has a valve seat 41 formed around the inlet 31 and a floating member 42 which will float up and cover valve seat 41 when the hydrocarbon liquid level within vapor receiving chamber 25 reaches check valve system 40. Floating member 42 can be made from a rigid plate 43 covered with a floating material 44, the combined weight thereof being small enough to permit floating member 42 to float in liquid hydrocarbons.

Figure 2:
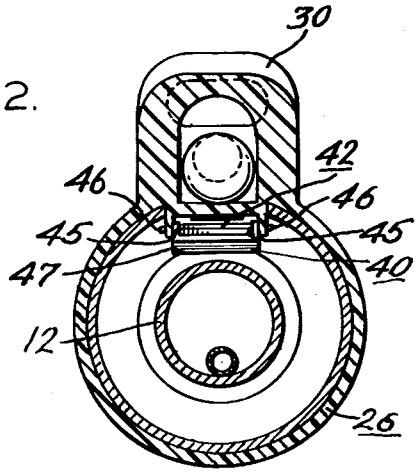
FIG. 2 is a sectional view of the nozzle and check valve system of FIG. 1 along the line 2—2.
Figure 3:
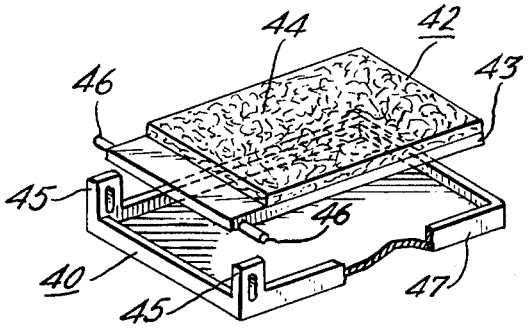
FIG. 3 is an enlarged view of one embodiment of the check valve system and its shield.

A guide mechanism is necessary to maintain floating member 42 in a proper position so that it will not close during flow of hydrocarbon vapors but will quickly react and close once the liquid level of liquid hydrocarbons reaches the check valve system. Guides 45, connected to the bottom of attitude valve 30, can be designed to properly limit the movement of floating section 42. Pins 46 of floating member 42 pass through guides 45 so that the movement of floating member 42 is similar to a hinge when it floats upward against valve seat 41. FIG. 1 illustrates the location of guides 45 in such a position that floating member 42 is pivoted on the front portion of attitude valve 30. Preferrably, guides 45 extend downward far enough to permit sufficient vapor flow on both sides of floating member 42 so that it is not forced up against valve seat 41 by the flow of vapors. However, guides 45 can also be constructed in conjunction with a vapor shield as illustrated in detail in FIG. 2.

Figure 4:
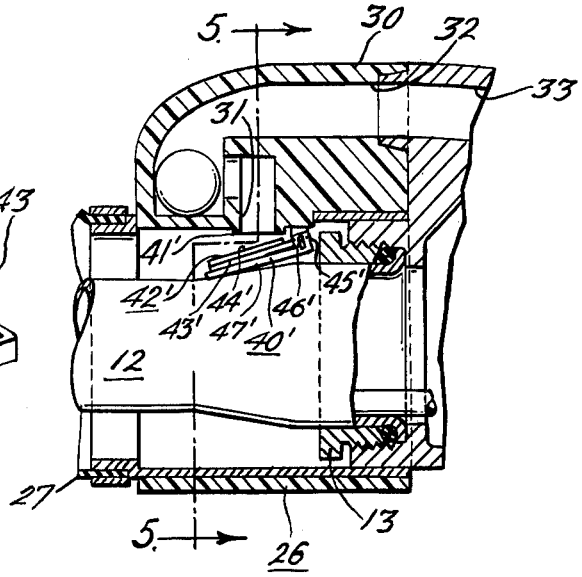
FIG. 4 is an enlarged view of a second embodiment of the check valve system.
Figure 5:
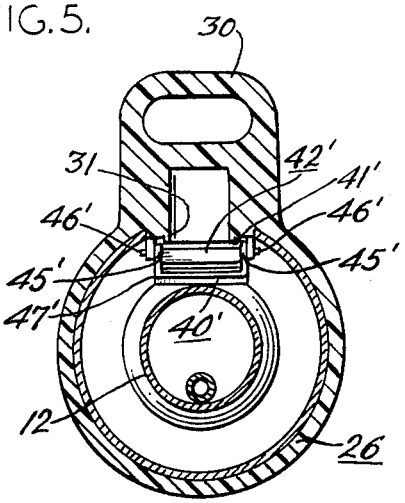
FIG. 5 is a sectional view of the nozzle and check valve system of FIG. 4 along the line 5—5.

A second embodiment, illustrated in FIGS. 4 and 5, show the installation of floating member 42' and guides 45' and shield 46' in the reverse direction, with like members of the first embodiment having identical numbers with prime designations. In this embodiment, guides 45' are mounted on the rear end of attitude valve 30 in vapor receiving chamber 25 so that floating member 42' is hinged in the opposite direction as the first embodiment. Installation of floating member 42' in this fashion causes flow of vapors to be incident on the top of floating member 42' so that it is not prematurely raised by the vapor flow. However, should the liquid level of gasoline reach inside the vapor receiving chamber to floating member 42', it will then float upward and block the passage of liquid into the vapor return line.

As can now be seen, a check valve system has been provided for use in a vapor receiving system of a dispensing nozzle, which is sensitive to the liquid level inside the vapor receiving system and acts to prevent the flow of liquid through the vapor receiving system into the vapor return line. If the liquid level inside the vapor receiving system should cause the check valve system to close, the operator would then become immediately aware of this fact and could turn off the nozzle.

While two embodiments of a float valve for such a check valve system have been illustrated, it is understood that many different valve designs, which are sensitive to the liquid level inside the vapor receiving chamber, could be used to perform the same function.

While a particular embodiment of this invention has been shown and described, it is obvious that changes and modifications can be made without departing from the true spirit and scope of the invention. It is the intention of the appended claims to cover all such changes modifications.

The invention claimed is:

1. A liquid fuel dispensing nozzle for dispensing fuel into a fuel tank and for receiving fuel vapors displaced from the fuel tank during the filling process, and wherein the nozzle has a system for preventing the flow of liquid fuel back through a vapor return line which carries the fuel vapors away from the nozzle, and comprising:

a. a nozzle housing;
b. a discharge spout connected to the nozzle housing;
c. means for controlling the flow of fuel through the nozzle;
d. a vapor receiving system having a vapor return passageway for allowing fuel vapors to flow to the vapor return line;
e. means, responsive to the liquid fuel backing up to the discharge spout, for automatically disabling the controlling means so that dispensing is terminated; and
f. means for preventing the flow of liquid fuel through the vapor receiving system and including a valve seat through which fuel vapors flow when they flow through the vapor receiving system, and means responsive to the level of liquid fuel in the vapor receiving system, for covering the valve seat, whereby when the liquid fuel level in the vapor receiving system reaches a predetermined level, the valve seat will be covered and liquid fuel will be prevented from flowing into the vapor return line.

2. The liquid fuel dispensing nozzle recited in claim 1, wherein the covering means comprises a flotatable member which floats up against the valve seat when the liquid level reaches the predetermined level.

3. The liquid fuel dispensing nozzle recited in claim 2 wherein:

a. said vapor receiving system includes a vapor receiving chamber surrounding the discharge spout, and said vapor return passageway connects the vapor receiving chamber to the vapor return line; and
b. means for mounting the flotatable member in the vapor receiving chamber so that it will float up against the valve seat when the liquid level reaches the predetermined level.

4. The liquid fuel dispensing nozzle recited in claim 3 and further comprising means for preventing the flow of vapors from urging the flotatable member towards the valve seat, whereby the valve sent will not be covered because of the flow of vapors against the flotatable member.

5. The liquid fuel dispensing nozzle recited in claim 1 wherein:

a. said vapor receiving system includes a vapor receiving chamber surrounding the discharge spout, and said vapor return passageway connects the vapor receiving chamber to the vapor return line; and b. means for mounting the flotatable member in the vapor receiving chamber so that it will float up against the valve seat when the liquid level reaches the predetermined level.

6. The liquid fuel dispensing nozzle recited in claim 1 and further comprising means for preventing the flow of vapors from urging the flotatable member towards the valve seat, whereby the valve seat will not be covered because of the flow of vapors against the flotatable member.

* * * * *